United States Patent [19]

Warthen

[11] Patent Number: 4,630,659

[45] Date of Patent: Dec. 23, 1986

[54] WINCH-POWERED WOOD SPLITTER

[76] Inventor: Joel W. Warthen, P.O. Box 105, Kellogg, Id. 83837

[21] Appl. No.: 727,728

[22] Filed: Apr. 26, 1985

[51] Int. Cl.[4] ..... B27L 7/00

[52] U.S. Cl. ..... 144/193 R; 144/193 D; 254/326; 280/408

[58] Field of Search ..... 144/193 R, 193 D, 366; 280/408, 493, 481; 254/327, 326, 325

[56] References Cited

U.S. PATENT DOCUMENTS

| | | | |
|---|---|---|---|
| 3,724,874 | 4/1973 | Simpson | 280/408 |
| 4,133,359 | 1/1979 | Jensen et al. | 144/193 R |
| 4,153,088 | 6/1979 | King et al. | 144/193 R |
| 4,216,941 | 8/1980 | Little | 254/326 |
| 4,240,476 | 12/1980 | Rattray | 144/193 R |
| 4,266,585 | 5/1981 | Denzer | 144/193 R |
| 4,285,374 | 8/1981 | Klingel | 144/193 A |
| 4,378,825 | 4/1983 | Schroeder | 144/193 R |
| 4,411,299 | 10/1983 | Alcott | 144/193 R |

*Primary Examiner*—W. D. Bray

*Attorney, Agent, or Firm*—Klarquist, Sparkman, Campbell, Leigh & Whinston

[57] ABSTRACT

A winch-powered wood splitting device designed for attachment to a motor vehicle is disclosed. A rectangular support frame is provided, in which a splitting blade and blade guide rails are positioned. An abutment member is attached to the support frame opposite the splitting blade. The abutment member secures a log or wooden object in position during splitting. The blade is positioned between the blade guide rails, thereby allowing movement of the blade along and through the guide rails. The blade is moved by a pulley mechanism on the underside of the support frame which connects to a vehicle-mounted winch. Operation of the winch pulls the blade toward the abutment member during operation. When splitting is completed, the blade is returned to a rest position by a spring mechanism mounted on the underside of the support frame.

8 Claims, 4 Drawing Figures

WINCH-POWERED WOOD SPLITTER

BACKGROUND OF THE INVENTION

1. Field of the Invention

This invention generally relates to wood splitting devices, and more particularly to motor driven, vehicle mounted wood splitting devices.

2. Discussion of the Prior Art

The increasing popularity of wood as an alternative fuel source has created a corresponding demand for log and wood splitting machines. Many types of log splitters have been previously manufactured. For example, U.S. Pat. No. 4,133,359 to Jensen, et al. discloses a gasoline engine-powered log splitter with a reciprocating trolley mechanism designed to force a log against a splitting wedge. The Jensen machine uses a series of complex mechanical linkages to transmit power from the engine to the trolley mechanism. U.S. Pat. No. 4,378,825 to Schroeder discloses a comparable machine powered by a hand-operated ratchet/pawl assembly.

However, Jensen, et al., Schroeder, and other prior art splitters have two major drawbacks. First, they are not easily movable. Second, the prior art devices lack convenient, inexpensive, and effective power sources. For example, the Schroeder device is hand-operated with limited splitting capacity.

U.S. Pat. No. 4,285,374 to Klingel is an attempt to solve the above-stated shortcomings. Klingel discloses a log splitting device transversely mounted on the front of a motor vehicle. The Klingel device uses a splitting ram powered by a hydraulic power source. A suggested source is an existing hydraulic pump of the motor vehicle. To operate effectively, the vehicle must have a suitable hydraulic pump which can be connected to the device with high pressure hydraulic fluid lines and seals. Such lines and seals are subject to leakage which can impair the effectiveness of the device.

Therefore, a need presently exists for portable wood splitting devices capable of operating economically, conveniently, and efficiently.

SUMMARY OF THE INVENTION

The present invention involves a wood splitting device designed for attachment to a motor vehicle. The device is powered by a vehicle-mounted winch.

The wood splitter basically consists of a rectangular support frame, a movable splitting blade, and blade guides. The blade guides consist of two parallel elongate rails. The splitting blade is positioned between the rails. To increase the splitting capacity of the invention, a wedge is mounted on the upper rear portion of the blade. In addition, an abutment plate is attached to the support frame for securing a log or wooden object during splitting.

The movable blade rests on a blade carriage sleeve with a circular orifice. A blade carriage shaft, located beneath the guide rails, is inserted in the orifice of the blade carriage sleeve. The blade carriage shaft is fixedly secured to the support frame, traversing the entire length of the frame. The carriage sleeve and blade move along the blade carriage shaft during splitting. A blade return spring is positioned on the blade carriage shaft to facilitate return of the blade to a rest position after splitting is completed.

The blade is moved by a drive transmission system on the underside of the support frame. The transmission system is powered by a vehicle-mounted winch. Operation of the winch pulls the blade toward the log or wooden object. When splitting is completed, the winch is deactivated and the blade returns to a rest position by action of the blade return spring.

One object of the present invention is to provide a wood splitting device which is easily transported.

A further object of the present invention is to provide a wood splitting device that is economical, convenient, and effective.

A still further object of the present invention is to provide a wood splitting device powered by a conventional, cost-effective power source.

Another object of the present invention is to provide a wood splitting device simple to operate and easy to maintain.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DETAILED DESCRIPTION

Figure 1:
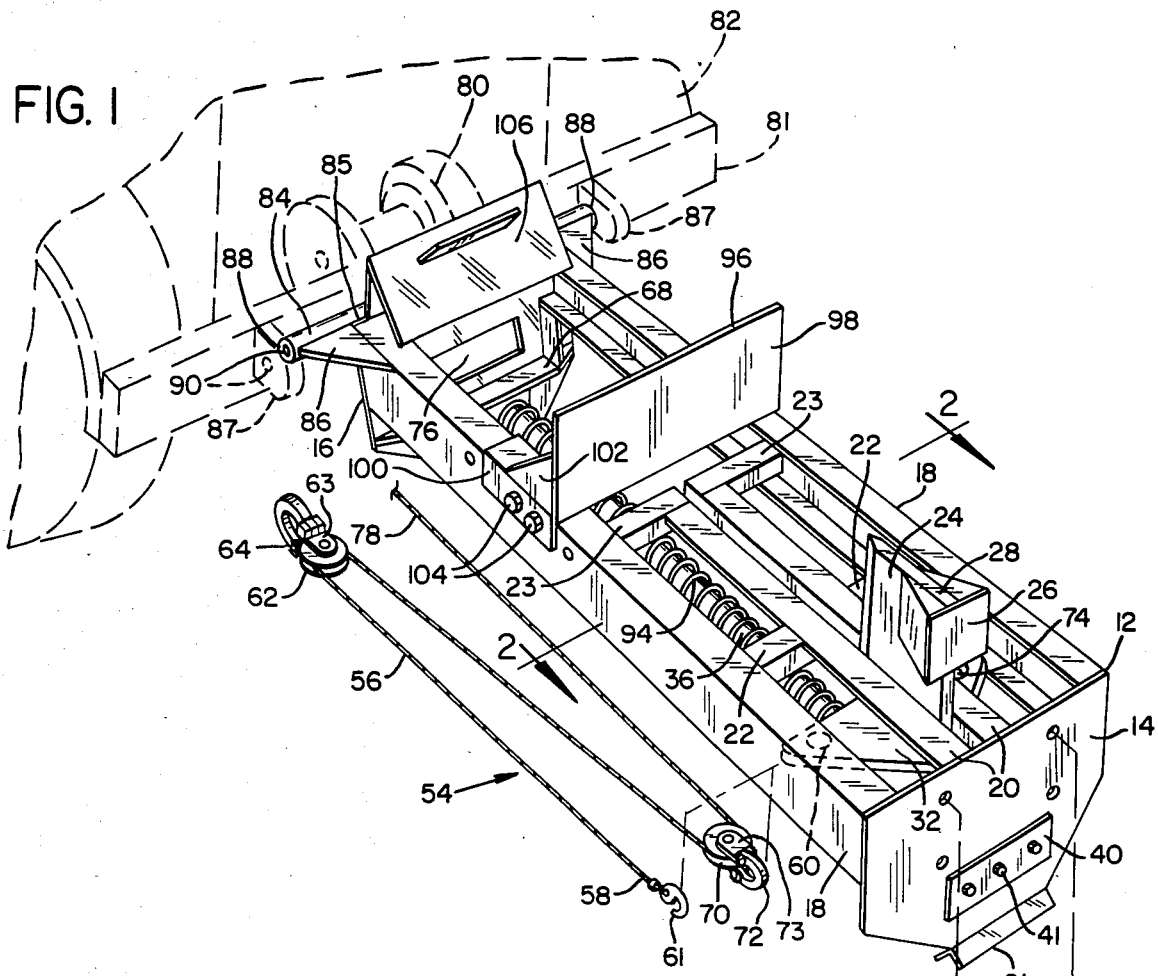
FIG. 1 is a perspective view of a wood splitter according to the present invention mounted to a motor vehicle.

Now, with reference to the drawings, a winch-powered wood splitter incorporating the principles and concepts of the present invention and generally referred to by the reference numeral 10 will be described in detail.

As shown in FIG. 1, the wood splitter consists of a rectangular support frame 12 constructed of frame end plates 14 and 16, and side bars 18. Mounted within support frame 12 are guide rails 20. Guide rails 20 preferably consist of angle-iron members. They are fixedly attached to frame 12 by support bars 22 and 23.

Figure 2:
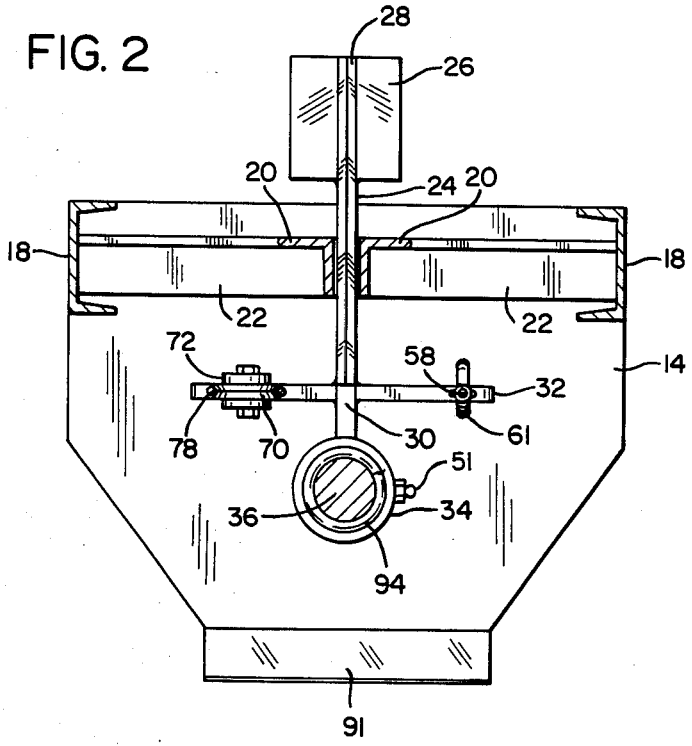
FIG. 2 is a sectional view thereof taken along line 2—2 of FIG. 1.
Figure 4:
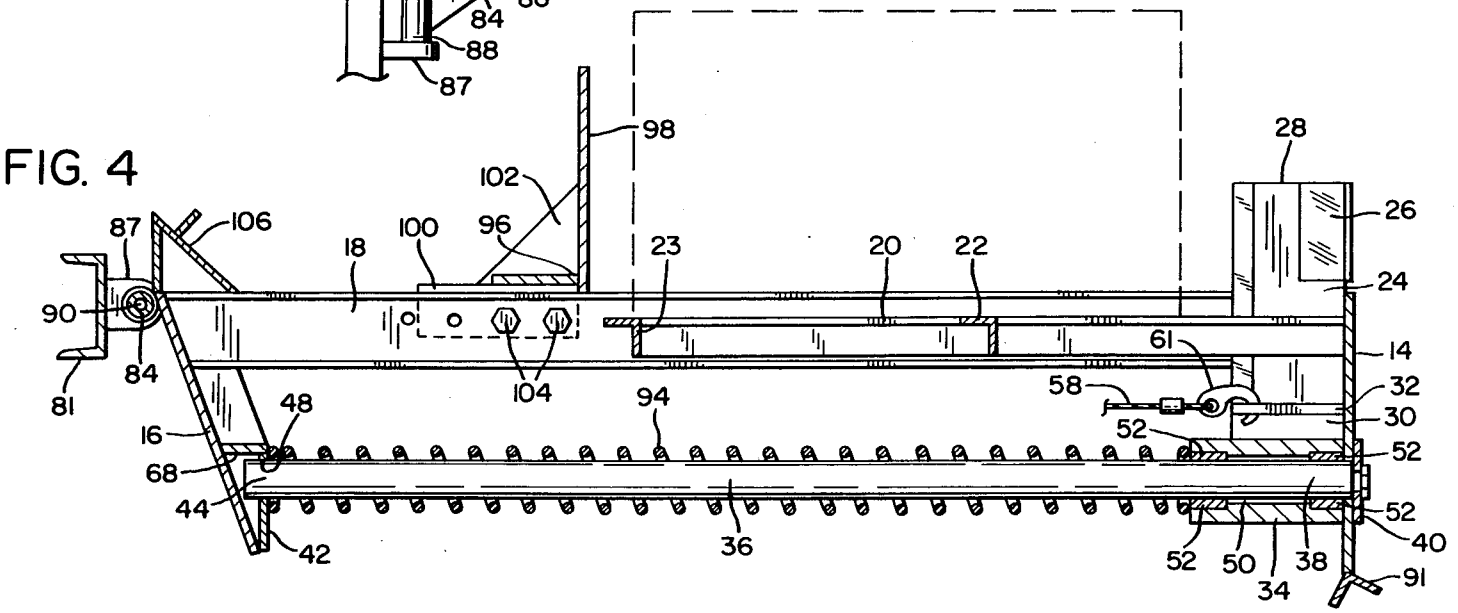
FIG. 4 is a side view thereof.

Guide rails 20 are positioned in a parallel relationship to each other. Also, they are spaced to allow passage of blade 24 therethrough, as shown in FIGS. 1 and 2. Blade 24 is freely movable between guide rails 20. To facilitate wood splitting, wedge 26 is attached to the upper end 28 of blade 24. With particular reference to FIGS. 2 and 4, the lower end 30 of blade 24 is rigidly secured to cable attachment member 32 and blade carriage sleeve 34.

Located beneath guide rails 20 in frame 12 is blade carriage shaft 36. Shaft 36 is positioned between frame end plates 14 and 16. As shown in FIG. 4, end 38 of shaft 36 is located within circular orifice 50 of blade carriage sleeve 34 when the apparatus is at rest. During operation of the splitter 10, carriage sleeve 34 moves longitudinally along blade carriage shaft 36. To facilitate such movement, lubricant is injected through grease fitting 51 to fill the cavity between bronze bushings 52 of sleeve 34. Movement of blade carriage sleeve 34 creates corresponding movement of blade 24 between guide rails 20. End 38 of shaft 36 is secured to frame end plate 14 by reinforcing plate 40 and bolt 41 (FIG. 1). End 44 of shaft 36 is inserted through orifice 48 of support plate 42. Plate 42 is secured to end plate 16, as shown in FIG. 4.

Figure 3:
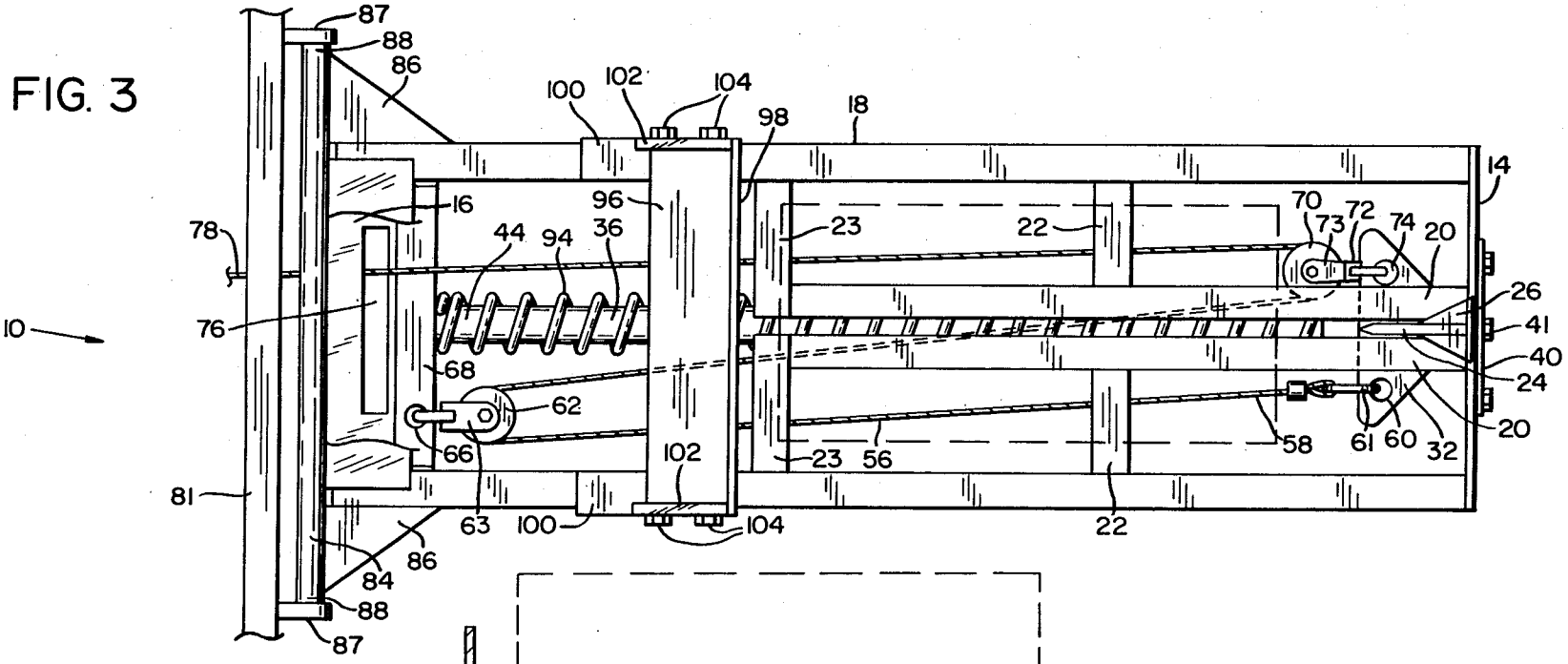
FIG. 3 is a top plan view thereof.

Blade 24 is moved longitudinally between guide rails 20 along shaft 36 by a power transmission configuration generally shown as 54 in FIG. 1. Specifically, drive cable 56 is anchored at end 58 to cable attachment member 32 at position 60 (FIG. 3). End 58 is anchored to cable attachment member 32 using cable hook 61. Drive cable 56 then extends away from cable attachment member 32 along the underside of support frame 12, and through a first snatchblock 64 that includes pulley 62 and sheave 63. Sheave 63 is anchored at position 66 of plate 68. Plate 68 is secured to end plate 16, as shown in FIGS. 1 and 4. From the snatchblock 64, drive cable 56 extends back toward cable attachment member 32 and through a second snatchblock 72 that includes pulley 70 and sheave 73. Sheave 73 is anchored to cable attachment member 32 at position 74, shown in FIG. 3. After passage through snatchblock 72, drive cable 56 traverses the underside of support frame 12 through slot 76 in end plate 16. End 78 of cable 56 is attached to the existing winch system 80 of motor vehicle 82 (FIG. 1).

In FIG. 1, wood splitter 10 is attached to the bumper 81 of motor vehicle 82 by hinge member 84. Hinge member 84 is rigidly secured to upper portion 85 of end plate 16. It is also secured by reinforcement members 86. Hinge member 84 is positioned between hinge brackets 87 located on bumper 81 of motor vehicle 82. Hinge brackets 87 and ends 88 of hinge member 84 have holes 90 for insertion of hinge pins or similar members therethrough. This design permits the pivotal rotation of wood splitter 10 to a vertical position during transport and to a horizontal position during operation.

In operation, wood splitter 10 is pivoted to a horizontal position and lowered until cleat 91 on end plate 14 touches the ground. A log or other wooden workpiece is then placed on guide rails 20. Motor vehicle winch 80 pulls drive cable 56 which moves blade 24 between blade guides 20 toward the log or other wooden workpiece. As blade 24 moves, carriage sleeve 34 slides along blade carriage shaft 36. As sleeve 34 moves along shaft 36, it compresses blade return spring 94. The log or other wooden workpiece is retained in position by abutment member 96 during splitting. As shown in FIG. 1, abutment member 96 is mounted to side bars 18 and consists of abutment plate 98, mounting members 100, and side supports 102. The position of abutment member 96 is selectively variable to accommodate logs and wood pieces of differing sizes. To change the position of abutment 96, bolts 104 are removed. Abutment 96 is then rebolted to side bars 18 at a different position.

After splitting, winch 80 is deactivated, and blade 24 returns to its initial position by the action of blade return spring 94 against blade carriage sleeve 34. For transport to a new location, wood splitter 10 is moved to a vertical position until bumper stop 106 touches bumper 81 of the vehicle 82.

An extension device 120 has a base plate 122 that is attachable to the end plate 14. If the splitter is to be moved short distances during a wood splitting session, caster 124 allows the splitter to travel without being rotated to an upright position. A trailer hitch cup 126 is positioned at the end of a forwardly extending tongue 128. If the vehicle 82 becomes stuck in soft ground or breaks down, another vehicle with a trailer hitch ball can be backed into position and hitched so that the splitter can act as a tow bar.

The foregoing description is only illustrative of the principles of the invention. Further, since numerous modifications and changes will readily occur to those skilled in the art, the invention is not limited to the exact construction and operation shown and described. Accordingly, all suitable modifications and equivalents may be resorted to, falling within the scope of the invention.

I claim:

1. A wood splitting device comprising:
   - a support frame;
   - a movable blade adapted for reciprocating motion along said support frame;
   - blade guide means for controlling the path of said blade, said blade guide means comprising two parallel elongate guide rails positioned to allow the passage of said movable blade therebetween;
   - an abutment member mounted on said support frame to limit the movement of a log or other wooden workpiece during splitting; and
   - drive transmission means suitable for connecting said movable blade to a winch such that when the winch is operated the blade is moved toward and into the workpiece.

2. The wood splitting device of claim 1 in which said device is attached to a motor vehicle.

3. The wood splitting device of claim 1 in which said support frame further comprises a spring means for returning said movable blade to its initial position after termination of splitting.

4. A wood splitting device comprising:
   - a support frame;
   - a movable blade adapted for reciprocating motion along said support frame;
   - a cable attachment member fixedly secured to said blade;
   - blade guide means mounted on said support frame for controlling the path of said blade;
   - an abutment member mounted on said support frame to limit the movement of a log or other wooden workpiece during splitting; and
   - a drive transmission comprising first and second pulley mechanisms to guide a drive cable which is securable to said cable attachment member so that said cable extends away from said attachment member toward and through said first pulley mechanism which is secured to said support frame, from which said cable extends away from said first pulley mechanism toward and through said second pulley mechanism which is secured to said attachment member, from which said cable extends away from said second pulley mechanism to a winch mounted on an adjacent motor vehicle, whereby when said winch exerts pulling force on said drive cable, said blade is pulled along and through said blade guide means toward and into said workpiece.

5. The wood splitting device of claim 4 in which said device is attached to a motor vehicle.

6. The wood splitting device of claim 4 in which said blade guide means comprises two parallel elongate guide rails fixedly attached within said support frame, said elongate guide rails being positioned to allow passage of said blade therebetween.

7. The wood splitting device of claim 4 in which said support frame further comprises a spring means for returning said movable blade to its initial position after termination of splitting.

8. A wood splitting device comprising:

a support frame attachable to the bumper of a motor vehicle;

a movable blade adapted for reciprocating motion along said support frame, said blade having upper and lower portions and a leading edge positioned to face a log or other wooden workpiece during splitting;

a splitting wedge fixedly secured to said upper portion of said blade;

a cable attachment member fixedly secured to said lower portion of said blade;

a blade carriage sleeve fixedly secured to said lower portion of said blade;

blade guide means positioned within said support frame for controlling the path of said blade, said guide means comprising two parallel elongate guide rails fixedly attached within said support frame, said elongate guide rails being positioned to allow passage of said blade therebetween;

a blade carriage shaft fixedly positioned within said support frame, said sleeve being slidably movable on and along said blade carriage shaft;

a blade return spring extending along said blade carriage shaft from said leading edge of said blade;

an abutment member mounted on said support frame to limit the movement of said workpiece during splitting;

a drive transmission comprising first and second snatchblocks to guide a drive cable which is securable to said cable attachment member on said blade so that said cable extends away from said attachment member toward and through said first snatchblock which is secured to said support frame, from which said cable extends away from said snatchblock toward and through said second snatchblock which is secured to said attachment member on said blade, from which said cable extends away from said second snatchblock to a winch mounted on said motor vehicle, whereby when said winch exerts pulling force on said cable, said blade is pulled along and through said blade guide means toward and into said workpiece, during which said blade carriage sleeve moves along said blade carriage shaft compressing said blade return spring until splitting of said workpiece is accomplished, and whereby, when said cable is subsequently slacked, said blade return spring pushes said blade carriage sleeve and attached blade away from said log or wooden workpiece.

* * * * *